US008496044B2

(12) United States Patent
Seimiya et al.

(10) Patent No.: US 8,496,044 B2
(45) Date of Patent: Jul. 30, 2013

(54) METHOD OF MANUFACTURING MASSIVE MIXTURE OF ALUMINUM NITRIDE AND ALUMINUM

(75) Inventors: Yoshihiro Seimiya, Hino (JP); Kanji Otsuka, Higashiyamato (JP); Ai Mizuno, Hino (JP)

(73) Assignee: Tama-TLO Ltd, Tokyo (JP)

( * ) Notice: Subject to any disclaimer, the term of this patent is extended or adjusted under 35 U.S.C. 154(b) by 245 days.

(21) Appl. No.: 12/934,403

(22) PCT Filed: Mar. 25, 2009

(86) PCT No.: PCT/JP2009/001312

§ 371 (c)(1),
(2), (4) Date: Oct. 28, 2010

(87) PCT Pub. No.: WO2009/119078

PCT Pub. Date: Oct. 1, 2009

(65) Prior Publication Data

US 2011/0056645 A1 Mar. 10, 2011

(30) Foreign Application Priority Data

Mar. 27, 2008 (JP) ..... P2008-083732

(51) Int. Cl.
*B22D 27/00* (2006.01)
*C22B 21/00* (2006.01)

(52) U.S. Cl.
USPC ..... 164/55.1; 75/686

(58) Field of Classification Search
USPC ..... 164/55.1; 75/68.6, 686
See application file for complete search history.

(56) References Cited

U.S. PATENT DOCUMENTS

| | | | | |
|---|---|---|---|---|
| 5,287,622 | A | 2/1994 | Terai | |
| 5,888,269 | A * | 3/1999 | Yamada et al. | 75/252 |
| 6,668,905 | B1 * | 12/2003 | Kadomura et al. | 164/97 |
| 2002/0031603 | A1 * | 3/2002 | Miyamoto et al. | 427/191 |

FOREIGN PATENT DOCUMENTS

| | | |
|---|---|---|
| JP | 55-038907 | 3/1980 |
| JP | 63-153285 | 6/1988 |
| JP | 08-003601 | 1/1996 |
| JP | 2000-192185 | 7/2000 |

OTHER PUBLICATIONS

Kobashi et al., Summary of 104th lectures of the Japan Institute of Light Metals(2003), vol. 2.
International search report dated Apr. 10, 2009.

* cited by examiner

*Primary Examiner* — Kevin P Kerns
*Assistant Examiner* — Steven Ha
(74) *Attorney, Agent, or Firm* — Rankin, Hill & Clark LLP

(57) ABSTRACT

A method of manufacturing a massive mixture of aluminum nitride and aluminum includes a first heat treatment process of manufacturing the massive mixture of aluminum nitride and aluminum by heating aluminum powder (21) and aluminum pieces (20) inserted into a vessel (13) at a temperature of a melting point of aluminum or higher under a nitrogen atmosphere. An oxide film is formed over the surface of the aluminum powder (21). The oxide film is, for example, a natural oxide film. The weight ratio of the aluminum powder (21) to the aluminum pieces (20) is, for example, 0.1 or less.

9 Claims, 1 Drawing Sheet

METHOD OF MANUFACTURING MASSIVE MIXTURE OF ALUMINUM NITRIDE AND ALUMINUM

TECHNICAL FIELD

The present invention relates to a method of manufacturing a massive mixture of aluminum nitride and aluminum.

BACKGROUND ART

Aluminum nitride is a material that has excellent properties, such as high heat conductivity, low heat expansion coefficient, chemical stability, and the like. Therefore, recently, there has been the expectation that aluminum nitride will be applied in a variety of fields, such as semiconductor devices, engine members, or the like.

As a method of manufacturing aluminum nitride in the related art, there is a method of heating aluminum at a high temperature (for example, 1600° C.) in a nitrogen atmosphere having a very high atmospheric pressure (for example, 100 atm). From this method, it is possible to produce powder of aluminum nitride. Non patent citation 1 discloses a study on the manufacturing of aluminum nitride.

[Non Patent Citation 1]

Kobashi Makoto, Saiki Kenzo, et al., Summary of 104$^{th}$ lectures of the Japan Institute of Light Metals (2003), vol. 2.

DISCLOSURE OF THE INVENTION

A composite material, in which aluminum nitride is mixed into aluminum, is regarded as exhibiting excellent characteristics. However, the above-described method is required to have a very high pressure or temperature in order to produce aluminum nitride. Therefore, the cost of manufacturing the massive mixture of aluminum nitride and aluminum is increasing.

The present invention has been devised in consideration of the foregoing problem, and the object of the invention is to provide a method of manufacturing a massive mixture of aluminum nitride and aluminum, which has a low manufacturing cost.

According to the present invention, the method of manufacturing a massive mixture of aluminum nitride and aluminum includes a first heat treatment process of manufacturing the massive mixture of aluminum nitride and aluminum by heating aluminum powder and aluminum pieces inserted into a vessel at a temperature of a melting point of aluminum or higher under a nitrogen atmosphere.

According to the present invention, the cost of manufacturing aluminum and aluminum nitride is lowered.

BRIEF DESCRIPTION OF THE DRAWINGS

The above and other objects, features and advantages will be more apparent from exemplary embodiments, which will be described hereinafter, and the following drawings appended thereto.

BEST MODE FOR CARRYING OUT THE INVENTION

Figure 1:
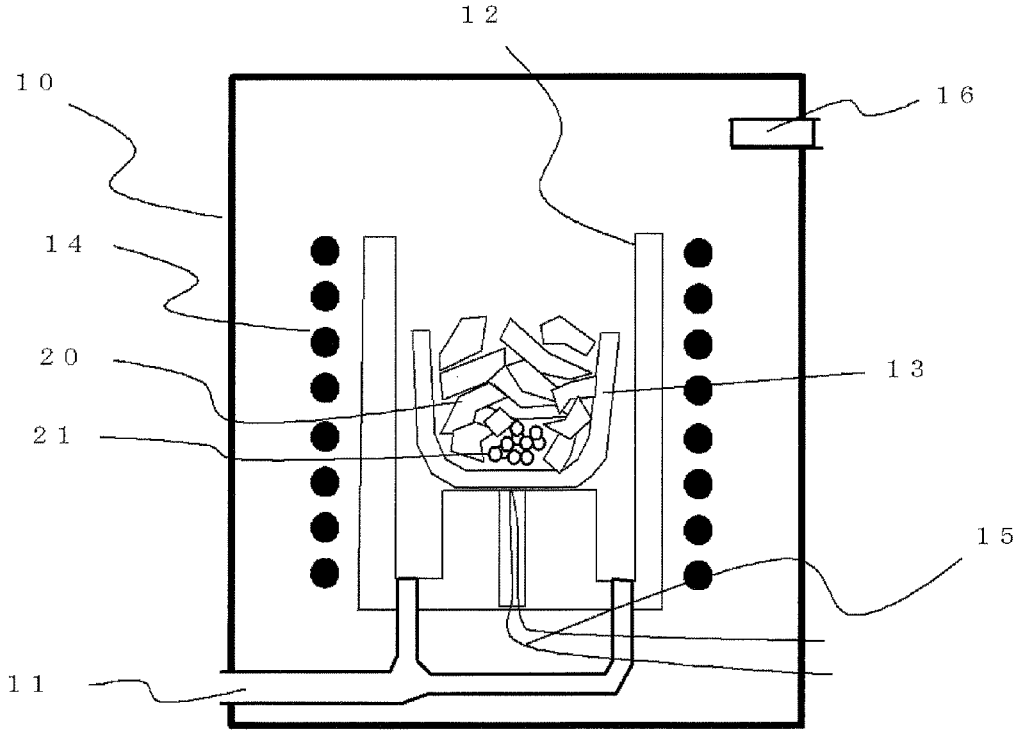
FIG. 1 is a configuration view showing a resistance furnace used in a first heat treatment process.

FIG. 1 is a configuration view showing a resistance furnace used in a method of manufacturing a massive mixture of aluminum nitride and aluminum according to a first embodiment. The resistance furnace has a reaction chamber 10. An exhaust port 16 and a gas intake port 11 are provided in the reaction chamber 10. Inside the reaction chamber 10, a resistance heater 14 (for example, a silicon carbide heater) for heating a vessel 13 is provided. Since a thermocouple is mounted on the vessel 13, it is possible to monitor the temperature of the vessel 13 from outside of the reaction chamber 10, through monitor lines 15 of the thermocouple. In addition, a uniform-heat sheath 12 for uniformly heating the vessel 13 is provided between the resistance heater 14 and the vessel 13. Gas, which is introduced from the gas intake port 11, is supplied into the reaction chamber 10 from inside of the uniform-heat sheath 12. The vessel 13 is made of, for example, alumina, and it is possible to make gas, such as nitrogen, penetrate into the vessel 13 from outside.

Next, a description will be given of the method of manufacturing a massive mixture of aluminum nitride and aluminum using the above-described resistance furnace. First, aluminum pieces 20 and aluminum powder 21 are placed into the vessel 13. The aluminum powder 21 is placed, for example, on the bottom of the vessel 13, and a plurality of the aluminum pieces 20 are placed over the aluminum powder 21. In the aluminum pieces 20, the longer edge is, for example, 10 mm to 500 mm, and the thickness is, for example, 5 μm to 1 mm.

The aluminum powder 21 can be granular or in the form of pieces of scale. If the aluminum powder 21 is granular, its grain size ranges, for example, equal to or more than 100 μm and equal to or less than 1000 μm. If the aluminum powder 21 is in the form of pieces of scale, its size ranges equal to or more than 1 μm and equal to or less than 5 μm in the longer edge. The aluminum powder 21 has an oxide film over the surface thereof. The oxide film is, for example, a natural oxide film. The weight ratio of the aluminum powder 21 to the aluminum pieces 20 is, for example, 0.1 or less.

In addition, the aluminum powder 21 can be heat-treated at a temperature below the melting point of aluminum, in a nitrogen atmosphere having a high pressure of 10 atm or more as preprocessing. In addition, the aluminum powder 21 can be converted into porous lumps using a press that applies mechanical pressure thereto. In this case, the porosity is, for example, 30% or more.

In addition, it is possible to coat the surface of the aluminum powder 21 with ammonium aluminate by immersing it into an ammonium aluminate solution, followed by drying it.

Afterwards, the vessel 13 is placed inside the uniform-heat sheath 12. Then, gas is continuously exhausted through the exhaust port 16 while nitrogen gas or a mixed gas, in which nitrogen gas and an inert gas are mixed, are being introduced from the gas intake port 11. Thereby, the air inside the reaction chamber 10 is substituted by a nitrogen atmosphere. It is preferable that the pressure of the nitrogen gas inside the reaction chamber 10 be, for example, an ordinary pressure atmosphere, in which the nitrogen gas overflows from the exhaust port 16. However, it can be a pressurizing atmosphere of 50 atm or less. In addition, it is possible to introduce ammonium gas on the nitrogen gas that is introduced from the intake port 11. The content of the ammonium gas in the gas introduced from the gas intake port 11 is, for example, equal to or more than 5% and equal to or less than 30%.

Afterwards, the vessel 13 is heated using a silicon carbide heater 14 up to a temperature of the melting point of aluminum or higher (for example, equal to or more than 650° C. and equal to or less than 1400° C.) at a temperature-rising rate of, for example, 2° C./min or more. Through this first heat treatment process, the aluminum 20 and the aluminum powder 21 are melted inside the vessel 13, thereby forming a massive mixture of aluminum nitride and aluminum through the nitridation reaction of aluminum. The process time is, for example, 5 to 20 minutes.

It is considered that this nitridation reaction of aluminum proceeds as follows. First, in the state where aluminum is melted, the oxide film, which was placed over the surface of the aluminum powder 21, remains temporarily in the state where it maintains the molten aluminum therein. That is, the oxide film, which was placed over the surface of the aluminum powder 21, temporarily isolates the molten aluminum powder 21 from the molten aluminum pieces 20. During that time, nitrogen in the atmosphere is received in the molten aluminum powder 21, so that the nitridation reaction of the molten aluminum powder 21 proceeds. In addition, the oxide film is torn at a predetermined timing, so that the molten aluminum powder 21 comes into contact with the molten aluminum pieces 20. The nitridation reaction of aluminum proceeds rapidly on this contact surface, since the nitridation reaction of aluminum is an exothermic reaction.

In addition, in the case where the surface of the aluminum powder 21 is coated with ammonium aluminate, the nitridation reaction of aluminum becomes easier since nitrogen is also supplied from ammonium aluminate. In addition, in the case where ammonium is included in the nitrogen atmosphere, hydrogen of a generating group, which is generated from decomposition of ammonia, accelerates the reduction of the oxide film over the surface of the aluminum powder 21. Thus, the generation of aluminum nitride is incurred even when the oxide film is relatively thick. In addition, the reaction rate can be accelerated by controlling the concentration of ammonia in the nitrogen atmosphere. In this case, it is suitable for the mass production of the massive mixture.

In the nitridation reaction of aluminum in the first heat treatment process, the rate, at which the nitridation reaction of aluminum proceeds, can be controlled by the process temperature and the pressure of atmospheric nitrogen. In addition, it is possible to change the state of the massive mixture (for example, the content of aluminum nitride) by controlling the process conditions of the first heat treatment, for example, the process temperature, the pressure of atmospheric nitrogen, the process time, the ratio of the aluminum powder 21 to the aluminum pieces 20, and the like.

For example, in predetermined process conditions, a massive mixture of aluminum nitride and aluminum, in which a plurality of aluminum nitride particles are bonded together by aluminum, is produced. In the resultant massive mixture, aluminum is located between a plurality of the aluminum nitride particles or between aluminum nitride, which is grown in the form of a network or net knots. In addition, it is possible to set the porosity of the massive mixture to be 1% or less. In addition, if the content of aluminum is equal to or more than 50% and equal to or less than 70%, the workability of the resultant massive mixture is improved. In addition, if the weight ratio of the aluminum powder 21 to the aluminum pieces 20 is 0.25 or more and the particle diameter of the aluminum powder 21 increases, a portion of the aluminum powder 21 remains in the massive mixture, thereby achieving a state in which pure aluminum particles are distributed uniformly in the network. By setting in this fashion, it is possible to maintain the growth of the massive mixture at up to 15% like that of aluminum even though the massive mixture has a greater hot strength.

In order to produce a formed product of a massive mixture in the following forming process, it is preferable that aluminum nitride remain in the distributed state without growth until it takes the form of a network. That is, it is preferable to stop the first heat treatment in the initial state of reaction. For example, the first heat treatment process is performed such that the content of aluminum nitride in the massive mixture becomes equal to or more than 5% and equal to or less than 30%, that is, the content of aluminum becomes equal to or more than 70% and equal to or less than 95% by weight. As control factors of a second heat treatment process, which will be described later, there are control factors, such as the content of aluminum nitride in the massive mixture after the first heat treatment process and the shape and distributed state of the aluminum nitride particles. However, these factors can be controlled by the first heat treatment process.

The average particle size of particles of aluminum nitride included in the massive mixture is generally fine, for example, on the order of micrometers. Furthermore, it is possible to distribute the particle sizes without scattering. It is possible to control this under the conditions of the first heat treatment, for example, on the order of 10 μm or 0.1 μm.

If the vessel 13 is large, a reaction becomes nonuniform since it is difficult to supply nitrogen into the massive mixture. Because of this, it is preferable to design the vessel 13 to be shallow and wide. In this case, it is possible to distribute the aluminum powder 21 in a plurality of positions. In addition, it is preferable that the reaction chamber 10 be a shallow and wide equilibrium furnace. In this case, the reaction chamber 10 can employ a pusher-type continuous furnace.

In addition, since the temperature of the first heat treatment can be lowered compared to the related art, the mixed introduction of impurities due to the evaporation of furnace materials is reduced. Thus, it is possible to produce a massive mixture having higher purity by raising the purity of the aluminum pieces 20 and the aluminum powder 21.

Afterwards, the massive mixture is pressure-molded by heating, followed by insertion between upper and lower molds corresponding to an intended shape (that is, a forming process). This forms the massive mixture into the intended shape.

The forming process is, for example, semi-solid forging or semi-molten forging. In the case of semi-solid forging, first, soluble components of the massive mixture are dissolved, and then, a portion of the dissolved components is set to remain in a solidified state by cooling the dissolved components to a predetermined temperature and maintaining the predetermined temperature. In addition, the massive mixture in this state is placed between upper and lower molds and is subjected to pressure molding. Details of semi-solid forging are methods that are described, for example, in Japanese Unexamined Patent Application Publication No. 2003-136223 or Japanese Unexamined Patent Application Publication No. 2004-322176.

In addition, in the case of semi-molten forging, first, all of the soluble components of the massive mixture are dissolved by heat treatment, and then, are poured into a mold, thereby forming a billet having a standardized shape. Afterwards, a portion of components of the billet is melted by heating the billet and maintaining it at a predetermined temperature, and the billet in that state is inserted between upper and lower molds.

In either case of semi-molten forging and semi-solid forging, it is preferable that the solid ratio of the massive mixture (or billet) be equal to or more than 30% and equal to or less than 90% in the step of inserting it between the upper and lower molds. In order to set the massive mixture to a predetermined solid phase ratio, for example, heat treatment time and temperature can be controlled.

In addition, before the forming process after the first heat treatment process, it is preferable that the upper and lower molds be preheated respectively, and then, that a mixture having a predetermined solid phase ratio be inserted between the upper and lower molds.

This forming process may be performed in a nitrogen atmosphere. In this case, the forming process becomes a second heat treatment process. Thus, aluminum in the massive mixture is subjected to nitridation reaction, thereby raising the content of aluminum nitride in the massive mixture. The pressure in the nitrogen atmosphere can be a normal pressure or a pressurized pressure. In the case of the pressurized pressure, it is preferable that the pressure be 10 atm or less.

Figure 2:
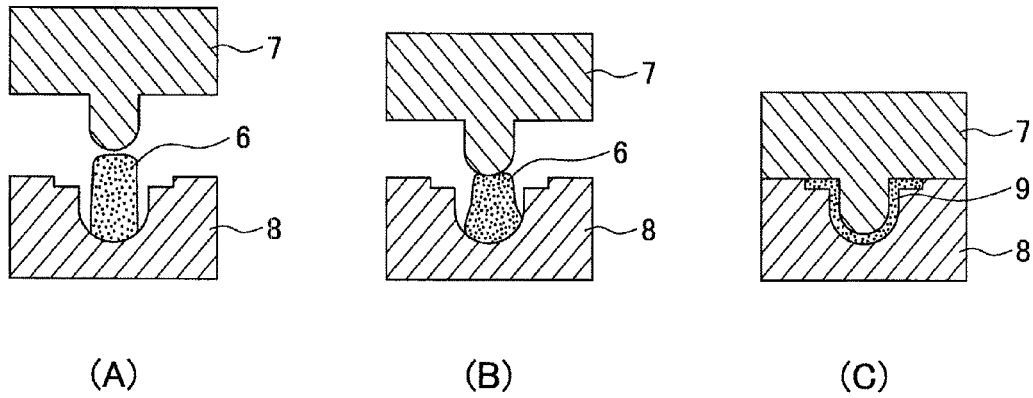
FIG. 2 is a cross-sectional view showing the operation of a mold in a forming process.

An example of the case in which the forming process is performed by semi-solid forging is shown in FIG. 2. First, as shown in FIG. 2(A), a massive mixture 6, which is properly preheated and is in the semi-solid state, is placed in the central portion of a lower mold 8, which is heated to a temperature lower than that of the massive mixture 6. Afterwards, as shown in FIG. 2(B), the massive mixture 6 in the semi-solid state is compressively deformed by moving an upper mold 7 toward the lower mold 8, and as shown in FIG. 2(C), a formed product 9 is completed by filling a space defined by the upper and lower molds 7 and 8 with the massive mixture.

It is preferable that the mold clamping speed of the massive mixture 6, which is being compressively deformed, be, for example, equal to or more than 0.01 m/s and equal to or less than 1.0 m/s. In addition, since the movement of the massive mixture 6 inside the molds varies dynamically, it is preferable that the mold clamping speed be varied according to the shape of the formed product. In addition, in the composition ratio or morphology of the semi-solid state, it is possible to vary this rate to several values. In addition, it is preferable that a stacking section be provided outside of the forming space of the molds, such that an excessive portion of the massive mixture 6 can be discharged thereto. Furthermore, the molds can be provided with an ejector pin, so that the molds can be easily separated from each other. Moreover, the temperature of the upper mold 7 and the lower mold 8 can be varied with respect to the temperature of the formed product 9 so that the molds can be easily separated from each other.

In addition, the characteristics of the resultant massive mixture or formed product 9 are changed variously by the ratio of aluminum nitride. For example, if the ratio of aluminum is high, the workability of the massive mixture or the formed product 9 is improved after that. If the ratio of aluminum is low, the characteristics of the massive mixture or formed product 9 become similar to those of aluminum nitride. In addition, since the surface of particles of aluminum nitride is coated with aluminum, good moisture resistance can be obtained.

As described above, according to the embodiments of the invention, it is possible to easily produce the massive mixture of aluminum nitride and aluminum and its formed product 9. In addition, when compared to the conventional method of producing a mixture, the manufacturing conditions include a low temperature or a low pressure. Therefore, the manufacturing cost is lowered compared to the conventional method. In addition, the formed product 9 of the resultant massive mixture has better mechanical strength, abrasion resistance, high heat conductivity, lightweight characteristics and toughness compared to metal aluminum alloys. Furthermore, since the starting sources are the aluminum powder 21 and the aluminum pieces 20, it is possible to reduce impurities included in the massive mixture.

In addition, the present invention is not limited to the above-described embodiments, but various variations can be made without departing from the scope of the invention.

For example, the forming process can employ liquid forging or casting. In this case, a portion of components of the massive mixture is dissolved by heating the massive mixture, so that the massive mixture has fluidity. Afterwards, molten metal is subjected to pressure molding or injection molding by flowing it into molds.

In addition, in order to improve the content of aluminum nitride in the formed product 9, it is possible to perform heat treatment on the massive mixture or the formed product 9 in a nitrogen atmosphere before or after the forming process (second heat treatment process). For example, the range of the heat treatment condition and the range of the pressure of the nitrogen atmosphere at this time are the same as those of the above-described forming process. In addition, the nitridation reaction of aluminum proceeds inside the massive mixture or the formed product 9.

The invention claimed is:

1. A method of manufacturing a mixture of aluminum nitride and aluminum, the method comprising, heating aluminum powder and aluminum pieces inserted into a vessel at a temperature of a melting point of aluminum or higher under a nitrogen atmosphere so as to manufacture said mixture of aluminum nitride and aluminum by nitriding melted aluminum, wherein a surface of said aluminum powder is coated with ammonium aluminate.

2. The method of manufacturing a mixture of aluminum nitride and aluminum according to claim 1, wherein an oxide film is formed over a surface of said aluminum powder.

3. The method of manufacturing a mixture of aluminum nitride and aluminum according to claim 1, wherein a weight ratio of said aluminum powder to said aluminum pieces is 0.1 or less.

4. The method of manufacturing a mixture of aluminum nitride and aluminum according to claim 1, comprising, forming said heated mixture using a mold after said heating aluminum powder and aluminum pieces.

5. The method of manufacturing a mixture of aluminum nitride and aluminum according to claim 4, wherein said forming process is semi-solid forging or semi-molten forging.

6. The method of manufacturing a mixture of aluminum nitride and aluminum according to claim 4, wherein said forming process comprises dissolving a portion of components of said mixture by heating said mixture, so that said mixture has fluidity, and then forming said mixture by injection molding or pressure molding.

7. The method of manufacturing a mixture of aluminum nitride and aluminum according to claim 6, wherein said forming process is casting or liquid forging.

8. The method of manufacturing a mixture of aluminum nitride and aluminum according to claim 4, wherein said mixture includes aluminum equal to or more than 70% and equal to or less than 95% by weight before said forming process.

9. The method of manufacturing a mixture of aluminum nitride and aluminum according to claim 4, comprising, heating said mixture in a nitrogen atmosphere after or before said forming process so as to cause nitridation reaction of aluminum in said mixture.

* * * * *